US011988081B2

(12) United States Patent
Weiss et al.

(10) Patent No.: US 11,988,081 B2
(45) Date of Patent: May 21, 2024

(54) GRAVITY ASSISTED RESERVOIR DRAINAGE SYSTEMS AND METHODS

(71) Applicant: GHW Solutions, LLC, Fort Worth, TX (US)

(72) Inventors: Jonathon Weiss, Fort Worth, TX (US); Stephen Andrew Graham, Fort Worth, TX (US)

(73) Assignee: GHW Solutions, LLC, Fort Worth, TX (US)

( * ) Notice: Subject to any disclaimer, the term of this patent is extended or adjusted under 35 U.S.C. 154(b) by 67 days.

(21) Appl. No.: 17/700,065

(22) Filed: Mar. 21, 2022

(65) Prior Publication Data

US 2022/0298900 A1 Sep. 22, 2022

Related U.S. Application Data

(60) Provisional application No. 63/164,374, filed on Mar. 22, 2021.

(51) Int. Cl.

| | |
|---|---|
| ***E21B 43/16*** | (2006.01) |
| ***E21B 41/00*** | (2006.01) |
| ***E21B 43/119*** | (2006.01) |
| ***E21B 43/26*** | (2006.01) |

(52) U.S. Cl.
CPC ..... *E21B 43/16* (2013.01); *E21B 43/119* (2013.01); *E21B 43/26* (2013.01); *E21B 41/0035* (2013.01)

(58) Field of Classification Search
CPC .. E21B 43/2408; E21B 43/2406; E21B 43/24; E21B 43/305; E21B 43/2401; E21B 43/26; E21B 43/16; E21B 43/20; E21B 43/243; E21B 43/30; E21B 36/04; E21B 43/2405
See application file for complete search history.

(56) References Cited

FOREIGN PATENT DOCUMENTS

| | | | | |
|---|---|---|---|---|
| CA | 2595018 C | * | 8/2011 | ..... E21B 43/305 |
| CA | 2740158 C | * | 6/2018 | ..... E21B 43/2406 |

* cited by examiner

*Primary Examiner* — Zakiya W Bates
(74) *Attorney, Agent, or Firm* — Crain Caton & James; William P. Jensen

(57) ABSTRACT

Gravity assisted reservoir drainage systems and methods, which improve preexisting reservoir drainage systems and artificial lift methods using the interwell hydraulic communication that exists between closely spaced horizontal wells in certain fully developed leases completed with large multi-stage hydraulic fracture treatments in batch fashion.

9 Claims, 5 Drawing Sheets

GRAVITY ASSISTED RESERVOIR DRAINAGE SYSTEMS AND METHODS

RELATED APPLICATIONS

This application claims priority to U.S. Provisional Application No. 63/164,374, filed Mar. 22, 2021, which is incorporated herein by reference.

FIELD OF THE DISCLOSURE

The following disclosure generally relates to gravity assisted reservoir drainage systems and methods. More particularly, the following disclosure relates to improved reservoir drainage systems and artificial lift methods for enhancing hydrocarbon recovery from mature reservoirs, which have been developed using closely spaced horizontal wells completed with large multi-stage hydraulic fracture treatments from multi-well pads in batch fashion.

BACKGROUND

The integration of horizontal drilling and multi-stage fracture stimulation technology using large volumes of low viscosity slick water fracturing fluid mixed with proppant (e.g., 40/70 and 100 mesh sand) to extract commercial quantities of natural gas was first demonstrated in the Barnett Shale Play in North Texas during the 1990s. By the end of the next decade, nearly 15,000 horizontal wells were completed in the Barnett Shale Play as operators sought to find other potential hydrocarbon fields to apply the transformational technology. One such area was the Eagle Ford Shale in South Texas, which was first tested in 2008.

Unlike the Barnett Shale Play, the Eagle Ford Shale Play was found to produce significant quantities of hydrocarbon liquids in the up-dip locations of the play. By the end of 2021, approximately 8,800 horizontal oil wells were completed within the most prolific core area of the liquids-rich Eagle Ford Shale Play. This core area is often referred to as the "Eagle Ford Volatile Oil Trend" (EFVOT). The EFVOT, which includes contiguous portions of Lavaca, Gonzales, DeWitt, Karnes, Live Oak, McMullen, and La Salle Counties, typically produces black oil with relatively low quantities of associated natural gas and formation water. In fact, a large percentage of the frac water introduced during the initial completion process in many liquids-rich shale developments, including the EFVOT, is never produced back indicating the rock matrix is likely hydrophilic and undersaturated (i.e., below critical water saturation). The reservoir in this core area is also geopressured (i.e., the reservoir fluids are abnormally over-pressured at a gradient that greatly exceeds hydrostatic pressure of approximately 0.5 psi per foot of depth) and represents the most densely developed area of the Eagle Ford Shale Play. The wells in the EFVOT typically have horizontal sections that extend between one and two miles in length, are spaced closer than 440 feet laterally apart, and were most often completed in simultaneous "zipper frac" batch operations from multi-well surface pad locations.

At its peak in 2015, this EFVOT area produced an average of about 875,000 barrels of oil per day from approximately 5,200 horizontal wells. By the end of 2021, the area was producing about 331,000 barrels of oil per day in aggregate or approximately 38 barrels of oil per day per well. However, due to the mature nature of the play and numerous technical challenges, approximately 7,200 of the 8,800 EFVOT wells were producing less than 20 barrels of oil per day and have only marginally economic remaining reserve potential using current exploitation practices.

By the end of 2021, the roughly 8,800 wells in the EFVOT produced almost 2 billion barrels of oil and 3.9 trillion cubic feet of associated natural gas, but this is generally thought to represent less than ten percent of the original hydrocarbons in place under leases that are fully developed with closely spaced horizontal wells. The main reason for the low recovery efficiency compared to more conventional oil reservoirs is the carbonate-rich shale/siltstone matrix, which has extremely low permeability, and the mixed wet organic pore spaces that are poorly connected. In fact, without massive hydraulic fracture stimulation treatments during the horizontal well completion process, there would be no economic recovery of hydrocarbons from shale and other ultra-low permeability oil reservoirs.

Constructive fracture interference between new closely spaced horizontal wells (e.g., less than 440 feet average lateral spacing) and fracture stages occurs during high-intensity, batch fracturing operations. This dynamic stress alteration phenomenon is thought to result in more productive fracture networks due in large part to the creation of more shear-failure hydraulic fractures, increased fracture complexity, and better fracture network containment in relatively close proximity to the horizontal well being completed.

Complex shear-slip fracturing within the upper part of the stimulated reservoir volume (SRV) located above the True Vertical Depth (TVD) of each lateral are often self-propping via dislocation of fracture surfaces, surface asperities/roughness, and hydraulic fractures held open by broken rock fragments. These fractures do not contain proppant and yet contribute significantly to well productivity and ultimate recovery as evidenced by the following facts: (a) larger, higher intensity fracture treatments of modern completions (e.g., post-2016 completions) generally perform significantly better than older completions, which had smaller fracture treatments (assuming all other relevant parameters are the same); (b) proppant represents only a small percentage of the total volume of material pumped in these more recent EFVOT completions (i.e., ~5%); and (c) sand of various mesh sizes in slick water was found in lab studies, computational fluid dynamics (CFD) analysis, and mine back experiments to propagate from perforation clusters similar to how sand dunes propagate. After a fracture treatment, most of the proppant is known to be in fractures located at or below the TVD of the lateral because the velocity and viscosity of the fracture fluid are insufficient to keep the proppant in suspension after it travels only a short distance from the wellbore. In conclusion, since better wells are resulting from these larger fracture treatments and most of the hydraulic fracture volume is related to fluid rather than the relatively small volume of proppant concentrated in fractures located at or below the TVD of the lateral (~95% water and 5% sand), the self-propped hydraulic fractures located above the lateral are likely contributing significantly to the achievement of higher estimated ultimate recoveries (EURs) of hydrocarbons in these more modern completions.

Another contributory cause for relatively low recovery efficiency in this area relates to the significant operational challenges related to artificially lifting these deep oil wells having long laterals (i.e., greater than 9,000 feet TVD and up to 21,000 feet measured depth (MD)). Current lift systems being used in these wells are predominately gas lift and mechanical rod pump. Gas lift is not optimum for late-life wells due to significant drawdown pressure limitations and is mainly used for deeper wells and for large, multi-well leases where gas lift is less expensive to operate compared to rod pump systems. Rod pumps are typically set around 1,000 feet or more above the base of the of the SRV to avoid rod/tubing wear caused by pumps set significantly below the horizontal well's kick off point. This pump setting configuration leads to stratified flow profiles and excessive back pressure on the reservoir (i.e., greater than 400 psi). Additionally, if the horizontal well is oriented in a downdip direction (i.e., the horizontal section has deeper TVDs as the well's MD increases), the effective backpressure on the SRV is even higher. Also, it is not uncommon for the horizontal well section to have an unintended undulating well path due to difficulties keeping the well trajectory stabilized toward the well's targeted bottomhole location at total depth (TD) during the drilling operation. These tortuous well paths introduce "pee trap" effects, which result in even higher backpressure in the horizontal section, cause the flow regime to become unstable (i.e., alternating slugs of liquids and gas), and lead to plugging of the cased horizontal wellbore from proppant flowback, fines, and completion debris during production operations with current artificial lift methods. Oil/gas slugging together with the associated abrasive solids sometimes contained within the fast-moving fluids also causes damage to the surface and downhole lift equipment.

Relatively constant gas-to-oil ratios (GORs) after the sand face pressure in a well's horizontal section drops below the oil bubble point pressure suggests bubble point suppression in the ultra-low permeability matrix (e.g., less than 10 nanodarcy). Bubble point suppression in the small oil-filled organic pore space of the EFVOT reservoir is thought to be caused by phase behavior changes related to the presence of kerogen and where pore-wall fluid interactions are significant due to confinement. Due to bubble point suppression within the organic pore space, natural gas remains in solution with the oil and therefore, the small gas molecules cannot move freely through the matrix. This effectively prevents depletion of the original reservoir pressure contained within isolated hydrocarbon-filled organic pore spaces during production operations even when they are located relatively close to connected hydraulic fractures. However, it is important to note that the gas quickly breaks out of solution within the open, pressure-depleted fractures and will tend to bypass the oil during production due to the higher mobility of natural gas than the more viscous crude oil.

In the geopressured EFVOT, the ultra-low permeability matrix may become micro-fractured around certain oil-filled organic pores located proximate to hydraulic fractures during production operations as the pressure drop at the interface between an open hydraulic fracture and an isolated hydrocarbon-filled organic pore exceeds the rock strength (e.g., reservoir pressure greater than 9000 psi and flowing bottomhole pressure—FBHP less than 2000 psi results in a pressure drop of more than 7000 psi across a short distance of formation rock). Slight shifting of rock fragments during these ongoing micro-fracturing events may result in persistent hydraulic communication between the "exploded" organic pore space and the complex hydraulic fracture network.

The connected pore space of an enhanced permeability region (EPR) adjacent to each stage-fractured horizontal section of a well includes both the hydraulic fracture volume and the nearby "exploded" pores. Initial flush production volumes exhibiting extremely steep exponential declines are believed to be correlative with the pore volume created around the EPR in the EFVOT. Typically, approximately half of each well's oil EUR is produced during the relatively short flush production period soon after the well is brought online. Late in the productive life of a well, the EPR is likely filled with heavier hydrocarbons due to the preferential flow of the lighter gas molecules into the well. The poor efficiency of prior art artificial lift systems coupled with low oil-to-gas mobility of EFVOT hydrocarbon fluids leads to the trapping of relatively "dead" (i.e., low GOR) crude oil, which is currently filling the connected pore volume in the EPR of each well's SRV.

Recovery efficiency in shale plays like the EFVOT using current state exploitation methods is also adversely affected by fracture hits or fracture-driven interference, which commonly occurs when fracture stimulating new infill "child" wells located close to previously produced "parent" wells. It is well known in the industry that fracture hits occur due to the lower stressed reservoir rock adjacent to the fracture networks of parent wells. This lower stressed rock condition is caused by pressure depletion from previous production operations. When conducting fracture stimulation operations on new infill child wells, hydraulic fractures will almost immediately orient themselves toward the fracture networks of parent wells due to the lower stressed rock. Fracture hits typically cause less complex bi-wing hydraulic fractures, which can extend for long distances away from new child wells being completed. These long bi-wing fractures can have relatively high conductivity but are not effective in developing shale and other ultra-low permeability reservoirs. Maximizing fracture complexity and surface area are first order drivers to successfully completing such low permeability reservoirs and are much more important to increasing well productivity and hydrocarbon recovery efficiency than fracture conductivity.

Among other issues, fracture hits are known to inhibit fracture complexity adjacent to the horizontal section of new infill wells due to production induced stress shadowing, thus reducing the effectiveness of child well completions. Fracture hits can also adversely affect the productivity of pressure-depleted parent wells due to interwell (between wells) hydraulic communication, thus dramatically increasing their production stream water cuts, which can increase liquid-loading and backpressure on their horizontal sections.

BRIEF DESCRIPTION OF THE DRAWINGS

The present disclosure is described with reference to the accompanying drawings, in which like elements are referenced with like reference numbers, and in which.

DETAILED DESCRIPTION OF THE ILLUSTRATIVE EMBODIMENTS

Figure 1:
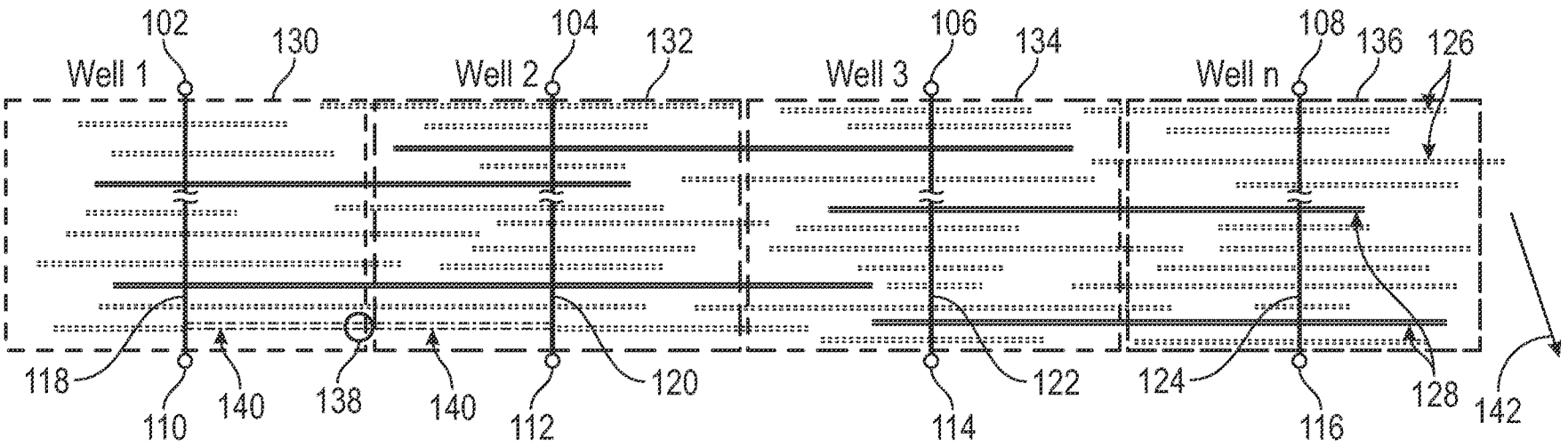
FIG. 1 is a conceptual plan view of a gravity assisted reservoir drainage system illustrating a typical multi-well development pattern, which includes preexisting closely spaced horizontal wells in a complex hydraulic fracture network, and a new, substantially vertical, well.

The subject matter of the present disclosure is described with specificity, however, the description itself is not intended to limit the scope of the disclosure. The subject matter thus, might also be embodied in other ways, to include different structures, steps and/or combinations similar to and/or fewer than those described herein, in conjunction with other present or future technologies. Although the term "step" may be used herein to describe different elements of methods employed, the term should not be interpreted as implying any particular order among or between various steps herein disclosed unless otherwise expressly limited by the description to a particular order. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures and dimensions described herein are only exemplary and are not intended to assert or imply any limitation with regard to the environment, architecture, design, or process in which different embodiments may be implemented. To the extent that any conditions (e.g., temperatures, pressures) are referenced in the following description, those conditions are merely illustrative and are not meant to limit the disclosure.

The gravity assisted reservoir drainage system disclosed herein is directed toward an improved drainage architecture and artificial lift solution for significantly increasing hydrocarbon recovery from certain liquids-rich shale and other ultra-low permeability reservoirs, which were previously developed using closely spaced horizontal wells that were batch completed with large multi-stage hydraulic fracture treatments and produce with relatively low GORs. A conventional artificial lift system (e.g., using gas lift or a sucker rod mechanical pump) usually must be installed during the first year of production operations due to severe liquid loading causing the wells to stop flowing naturally. Within the first decade after producing these wells, oil and gas rates often have declined to near uneconomic rates in part due to inefficiencies related to the reservoir drainage architecture and the artificial lift systems being used. At this point, the production operation for such wells typically recovers only ten percent or less of the original hydrocarbons in place within the targeted completion zone and drainage area defined by half the distance to the nearest neighbor well on both sides of the well. The gravity assisted reservoir drainage system disclosed herein may be used to increase the recovery efficiency of these late-life, fully developed leases.

Implementation of a gravity assisted reservoir drainage system includes drilling a new, substantially vertical, well within a complex hydraulic fracture network created during the completion process of the preexisting closely spaced horizontal wells. More specifically, the new well may be located in close proximity to at least one of the closely spaced horizontal wells that has already been used for production and whose fracture network is partially pressure depleted compared to the original reservoir pressure. The new well may be completed with perforations and a hydraulic fracture stimulation treatment. The gravity assisted reservoir drainage system takes advantage of the highly conductive bi-wing fractures that will extend from the child well and into the horizontal section of at least the closest offset horizontal parent well. In this manner, the new well completion will be in persistent hydraulic communication with at least the closest preexisting horizontal well. The new well may then be configured with a downhole pump (e.g., instrumented electric submersible or insert rod-driven pump) positioned in a "cased sump" located below or at least very near the perforations. The new well includes a directional well with a substantially vertical section located adjacent to the complex hydraulic fracture network.

The gravity assisted reservoir drainage system disclosed herein leverages and thus, overcomes the disadvantages of interwell hydraulic communication that exist in certain fully developed leases (e.g., EFVOT) as explained more fully below.

Perforation cluster efficiency can be defined as a measure of how the fracture fluid and proppant is distributed among the various perforation clusters in a given pumping stage. A perforation cluster is generally comprised of multiple perforations placed within one or two feet along the length of the casing in the horizontal section of a well and is considered a discrete fracture entry point. A typical single pumping stage in a horizontal completion in the EFVOT can have from four to more than ten perforation clusters along a length of casing in the horizontal section of approximately 250 feet. A higher perforation cluster efficiency value would indicate a more even distribution of fracture materials placed through each discrete perforation cluster of a given pumping stage. For example, 100 percent cluster efficiency for a ten-cluster stage being stimulated at an injection rate of 100 barrels per minute (BPM) would mean that each cluster was being treated at an average rate of 10 BPM during the pumping operation of that stage. In most shale and other ultra-low permeability reservoirs, poor perforation cluster efficiency often occurs in at least a few stages in most horizontal completions. This is particularly the case in older wells completed before 2016.

Contributory causes of poor perforation cluster efficiency may include (a) stress shadowing, (b) proppant settling toward the toe-side clusters as injection rates decrease and carry velocities are insufficient, (c) inertial effects due to density differences between the fracture fluid (e.g., water) and proppant (e.g., sand) causing increasing proppant concentration toward the toe of each stage as the relatively dense proppant bypasses heel-side clusters, (d) natural fractures or other planes of weakness located in close proximity to one of the perforation clusters, (e) minerology or in-situ stress anisotropy across the length of a stage, and/or (f) inadequate entry perforation strategies. Due to the combined effect of the first three causes of poor cluster efficiency listed above and in older completions that utilized inadequate entry perforating strategies, there was often a tendency for "heel-side bias." In other words, for wells that used less modern completion designs, the clusters of a given stage located closer to the heel of the horizontal section of the well would tend to take a disproportionately large amount of the fracture fluid and proppant than the clusters located closer to the toe of the well.

Poor perforation cluster efficiency may result in "super clusters" that take significantly more than an equal share of the proppant and fluid pumped in a given multi-cluster stage. Super clusters have relatively simple bi-wing fractures and effective fracture half lengths that often greatly exceed the lateral well spacing. Multi-layer propped fractures resulting from "sand dune propagation" located at or below the TVD of the lateral well likely remain open late in the productive life of each well when the in-situ forces acting to close the fracture are greatest. Super clusters that extend between closely spaced horizontal wells and are partially filled with a significant quantity of proppant create persistent hydraulic communication between horizontal wells. This phenomenon is evidenced by interwell hydraulic communication (e.g., shut-in or fracture operations affecting production performance on the adjacent lease, pressure interference testing between wells, and other reservoir diagnostic techniques) and the success of multi-well rich gas injection IOR processes.

The near infinite hydraulic conductivity within the production casing in each horizontal wellbore facilitates movement of hydrocarbons and other subterranean fluids between the single-well complex fracture networks (i.e., SRVs) created from most of the fracture stages during the completion of each closely spaced horizontal well via the overlapping hydraulic fractures resulting from the super clusters. The typical inside diameter of the steel alloy production casing used in EFVOT horizontal wells is approximately 4.5 inches. The casing in the horizontal section has significantly greater conductivity than the connected hydraulic fractures of an SRV, which has much greater conductivity than the reservoir matrix permeability.

Therefore, since the new vertical well completion will be designed to have persistent hydraulic communication with at least the closest preexisting offset horizontal well via high conductivity bi-wing fractures, it is effectively in hydraulic communication with many other closely spaced horizontal wells for a much larger drainage area. The lower take point in the common reservoir shared by the closely spaced horizontal wells enables the drawdown pressures to be significantly higher than conventional methods for artificially lifting horizontal wells. The improved reservoir take point architecture will also deliver benefits related to gravity drainage whereby incompressible liquids are more effectively fed to the pump while more of the natural gas is retained in the reservoir allowing it to expand and drive liquid hydrocarbons out of ancillary fractures and micro pore space, thus increasing hydrocarbon recovery.

In one embodiment, the present disclosure includes a gravity assisted reservoir drainage system, which comprises: i) a plurality of preexisting horizontal wells, wherein each preexisting horizontal well is located within a respective stimulated reservoir volume created during its completion which includes at least one non-overlapping hydraulic fracture; ii) at least one overlapping hydraulic fracture fluidly connecting at least one of the plurality of preexisting horizontal wells to an adjacent one of the plurality of preexisting horizontal wells; and iii) a new well, wherein the new well is completed within a stimulated reservoir volume containing the at least one overlapping hydraulic fracture after completion of the plurality of preexisting horizontal wells and includes a hydraulic fracture fluidly connecting the new well and at least one of the plurality of preexisting horizontal wells connected by the at least one overlapping hydraulic fracture.

In another embodiment, the present disclosure includes a gravity assisted reservoir drainage method, which comprises: i) drilling a new well between two preexisting horizontal wells, wherein each preexisting horizontal well is located within a respective stimulated reservoir volume created during its completion and which includes at least one non-overlapping hydraulic fracture and at least one overlapping hydraulic fracture fluidly connecting the two preexisting horizontal wells; ii) forming a hydraulic fracture fluidly connecting the new well and at least one of the two preexisting horizontal wells; iii) draining hydrocarbon fluids with gravity assistance from at least one stimulated reservoir volume through the at least one non-overlapping fracture of at least one of the two preexisting horizontal wells, the at least one of the two preexisting horizontal wells, and the hydraulic fracture into a bottom of the new well; and iv) pumping the hydrocarbon fluids from the bottom of the new well to a surface.

Referring now to FIG. 1, a conceptual plan view of a gravity assisted reservoir drainage system 100 is illustrated, which includes preexisting closely spaced horizontal wells in a complex hydraulic fracture network and a new, substantially vertical, well. As depicted by the formation dip 142 and the roughly parallel and cased sections (118, 120, 122, 124) of each horizontal well, the horizontal wells are drilled in a generally downdip direction. These wells are considered "toe down" well profiles because the TVD is deeper at each well's total depth than the TVD when each horizontal well enters the targeted reservoir near the end of its angle build section (i.e., the "heel" of the well). Each horizontal well includes a heel location (102, 104, 106, 108), and a respective bottomhole location (110, 112, 114, 116).

Each of the horizontal wells has been batch completed using a high intensity stage-fracturing operation with slick water to create a complex fracture network or "SRV" around each horizontal well, which is bounded laterally by half the distance to an adjacent well in both directions. The targeted SRV for each well (130, 132, 134, and 136) is represented by a dashed rectangular-shaped box. Exemplary non-overlapping hydraulic fractures 126, which are isolated to a single horizontal well, and exemplary overlapping hydraulic fractures 128, which extend from one horizontal well to an adjacent horizontal well, are created during the batch stage-fracturing operation of the horizontal wells. The overlapping hydraulic fractures 128 extending from super clusters, which have multiple layers of proppant and a relatively high fracture conductivity at and below the TVD of the horizontal section of each horizontal well, contribute to the hydraulic communication between the horizontal wells.

A new, substantially vertical, well 138 may be positioned about midway between the cased sections 118 and 120 at a location that overlies one of the initial fracture stages proximate to the bottomhole locations 110 and 112 (e.g., near the toe of the cased sections 118 and 120). The spacing between the new well 138 and the adjacent horizontal wells (Well 1 and Well 2), for example, may be less than 220 feet if the spacing between Well 1 and Well 2 is less than 440 feet.

The new well 138 may be completed with perforations and a specially designed hydraulic fracture stimulation treatment that will ensure a fracture hit with at least one of the adjacent cased sections 118 and 120 and persistent hydraulic communication via a new hydraulic fracture 140 extending from the new well 138 to at least one of the adjacent cased sections 118 and 120. The new well 138 thus, takes advantage of interwell hydraulic communication resulting from the original completion of the closely spaced horizontal wells using large, high intensity, multi-stage hydraulic fracturing that may have experienced poor perforation cluster efficiency in at least one stage of each well. The hydrocarbons may be drained into the new well 138 by gravity and the use of a combination of non-overlapping hydraulic fractures 126, cased sections (118, 120, 122, 124), overlapping hydraulic fractures 128 and/or the new hydraulic fracture 140 created during completion of the new well 138. For example, any hydrocarbons remaining within the reservoir matrix in targeted SRV 134 could flow into non-overlapping fractures 126, which could then flow into the cased section 122 of Well 3, which could then flow into overlapping hydraulic fractures 128 to the cased section 120 of Well 2, which could then flow into the new hydraulic fracture 140 and finally into the new well 138 before being pumped to the surface.

Figure 2:
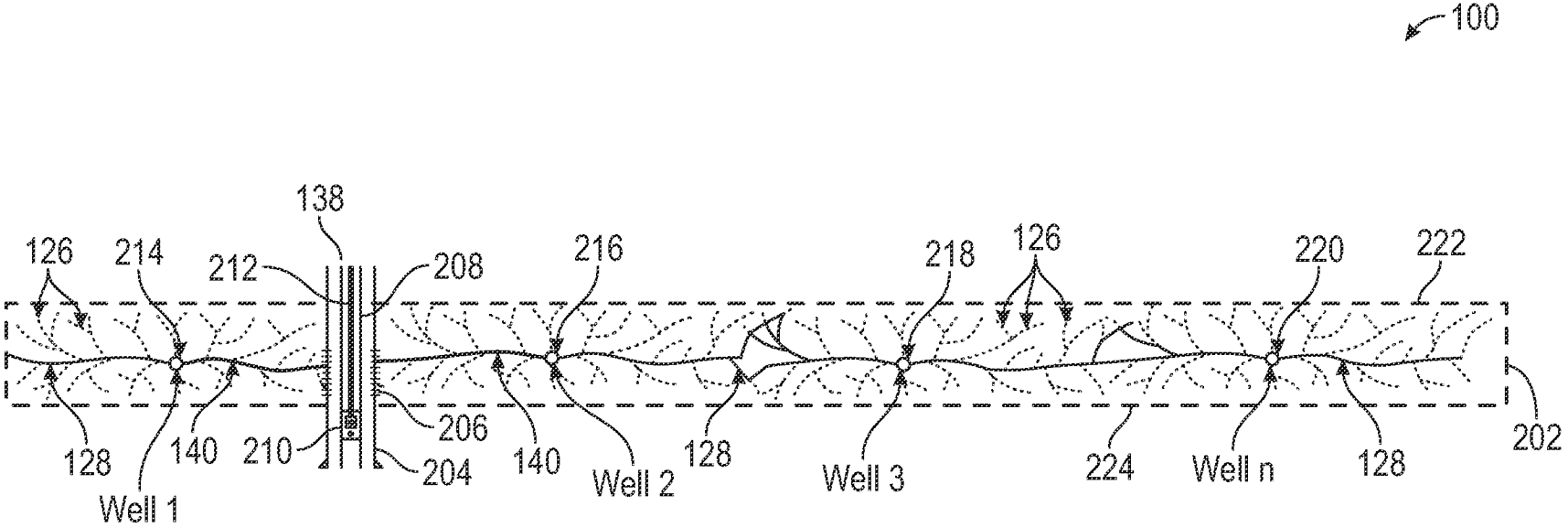
FIG. 2 is an elevation view of the gravity assisted reservoir drainage system in FIG. 1 at a location near a down-dip fracture stage illustrating the connectivity of the hydraulic fracture network.

FIG. 2 illustrates an elevation view of the gravity assisted reservoir drainage system 100 in FIG. 1 at a location near a down-dip fracture stage. Each downhole location (214, 216, 218, 220) represents a location near a down-dip fracture stage that is near a total depth (i.e., close to the toe) for a respective horizontal well. The combination of non-overlapping hydraulic fractures 126, overlapping hydraulic fractures 128 and horizontal wells are hydraulically connected within a combined SRV 202. The non-overlapping hydraulic fractures 126 and the overlapping hydraulic fractures 128 are bounded vertically at the top of the combined SRV 202 by an upper formation interval 222 that is not prone to being hydraulically fractured. Likewise, the combined SRV 202 is bounded at its lower end by a difficult to fracture lower formation interval 224.

The completed new well 138 includes cemented production casing 204 and perforations 206 through which a specially designed hydraulic fracture stimulation treatment may be pumped to create the new hydraulic fracture 140, which extends to the downhole locations 214 and 216 for Well 1 and Well 2, respectively, and provides persistent hydraulic communication between the new well 138 and Well 1, Well 2. Production tubing 208, sucker rods 212, and a downhole insert pump 210 are run in the new well 138 prior to initiating production. The insert pump 210 is preferably located below the bottom of the perforations 206 and the lower formation interval 224 for a lower take point in the reservoir.

Figure 3B:
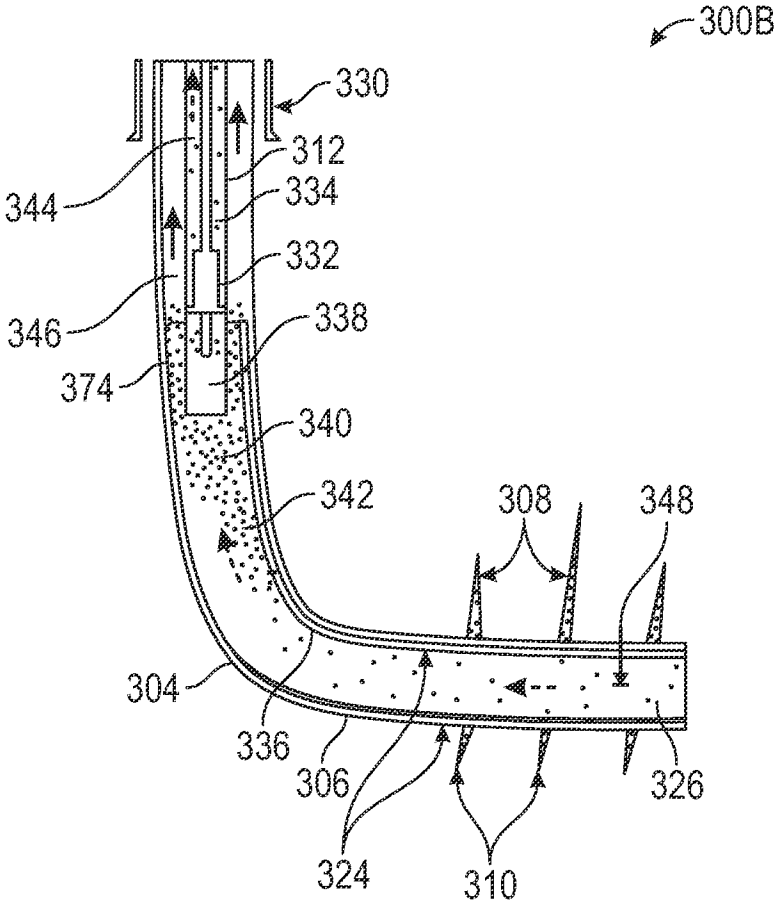
FIG. 3B (PRIOR ART)
FIG. 3B is a cross-section view of a conventional rod pump lift system for use within one or more of the horizontal wells shown in FIG. 2.
Figure 3A:
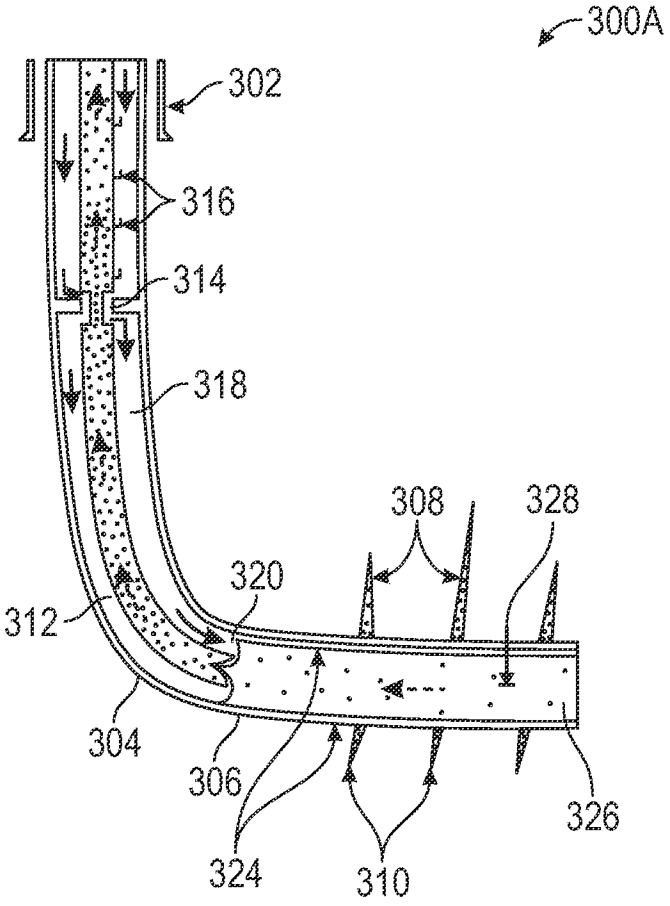
FIG. 3A (PRIOR ART)
FIG. 3A is a cross-section view of a conventional gas lift system for use within one or more of the horizontal wells shown in FIG. 2.

FIG. 3A illustrates a cross-section view of a conventional gas lift system 300A for use within one or more of the horizontal wells shown in FIG. 2. A preexisting horizontal well 302 includes a horizontal section 306 and is completed using cemented production casing 304 with hydraulic fractures 308 and 310. Additionally, a gas lift system has been installed within horizontal well 302, which includes production tubing 312 set near the beginning of the horizontal section 306, a packer bypass 314, which allows for a deeper gas injection point during gas lift operations, and gas lift valves 316.

During production operations, a high-pressure natural gas is injected down the tubing/casing annulus 318 to an end 320 of the production tubing 312 where the gasified crude oil and formation water mixture flows up the production tubing 312 to the surface. Mixing the injected natural gas with oil/water mixture lightens the hydrostatic head of the fluid in the production tubing 312 and uses the available FBHP to facilitate a flowing condition for horizontal well 302. As the horizontal well 302 produces with gas lift, a stratified flow 324 occurs due to gravity separation whereby substantially liquid-free gas is flowing at the top of the horizontal section 306 while liquid with a higher water cut is flowing at the bottom of horizontal section 306. Gravity separation in the horizontal section 306 occurs due to the relatively low fluid velocity 326 of the crude oil, natural gas, and formation water production stream entering the production casing 304 from hydraulic fractures 308 and 310. The hydraulic fractures 308 have a higher GOR than the hydraulic fractures 310 located below the TVD of the horizontal section 306.

The FBHP at the midpoint 328 of horizontal section 306 for a typical gas lifted horizontal well 302 can be estimated by summing the flowing tubing pressure (FTP), the hydrostatic head of the oil/gas/water mixture contained within the vertical section of the tubing, fluid friction caused by the fluid mixture flowing up the tubing, and the hydrostatic head of the oil/gas/water mixture contained in the horizontal section 306 of the well due to formation dip (applicable to toe down well profiles) and the thickness of the SRV. For a typical 12000 feet TVD horizontal oil well with a producing GOR of less than 2500 standard cubic feet per barrel of oil (SCF/BBL), a 6000 lateral feet toe down well profile, formation dip of 3°, 100 feet of SRV thickness, and 0.85 gravity fluid, the FBHP is estimated to range from 300 to 1000 psi depending on the FTP resulting from local gas compression facilities.

FIG. 3B illustrates a cross-section view of a conventional rod pump lift system 300B for use within one or more of the horizontal wells shown in FIG. 2. A preexisting horizontal well 330 includes a horizontal section 306 and is completed using cemented production casing 304 with hydraulic fractures 308 and 310. Additionally, a rod pump lift system has been installed within horizontal well 330, which includes production tubing 312 set substantially above the horizontal section 306 near a directional kickoff point 374 where the well inclination begins to increase from ~0° (vertical) to ~90° (horizontal), a downhole insert pump 332, and sucker rods 334.

During production operations, the sucker rods 334 reciprocate with the insert pump 332 and are designed to lift gas-free crude oil and water 344 from the TVD where the pump 332 is set to surface while dry natural gas flows up the tubing/casing annulus 346 due to the configuration of the pump intake and gravity separation. Mechanical pumps like insert pump 332 are designed to pump incompressible fluids, however, it is not uncommon for natural gas to be inadvertently sucked into the intake of the insert pump 332, which significantly reduces the pump efficiency as the compressible gas simply expands and contracts as the insert pump 332 reciprocates without passing through the traveling valve in the insert pump 332. Less gas would enter insert pump 332 if it were possible to locate the insert pump 332 below the reservoir, but that is not possible for horizontal wells using prior art reservoir drainage architectures and artificial lift methods. Immediately below the intake of insert pump 332, an area of unstable flow with alternating slugs of liquid/gas and frothy fluid exists, which contributes to the problem of natural gas entering insert pump 332.

As the horizontal well 330 produces with rod pump lift, a stratified flow 324 occurs due to gravity separation whereby substantially liquid-free gas is flowing at the top of the horizontal section 306 while liquid with a higher water cut is flowing at the bottom of horizontal section 306. Gas channeling 336 occurs along the top of the production casing 304 in the horizontal section 306 due to the significantly higher mobility of natural gas compared with crude oil or formation water (i.e., natural gas has much lower viscosity than formation liquids). Gravity separation in the horizontal section 306 occurs due to the relatively low fluid velocity 326 of the crude oil, natural gas, and formation water production stream entering production casing 304 from hydraulic fractures 308 and 310. The hydraulic fractures 308 have a higher GOR than the hydraulic fractures 310 located below the TVD of the horizontal section 306.

For typical horizontal wells in liquids-rich shale and other ultra-low permeability reservoirs, the distance from the TVD of the directional kickoff point 374 (where insert pump 332 is typically set) to the average TVD of the base of the SRV is greater than 1000 feet. With this well/reservoir architecture, the available FBHP (i.e., remaining reservoir pressure in the SRV less fluid friction) is required to lift the formation liquids approximately 1000 feet to the intake of insert pump 332. Also, because of gas channeling 336, a significant amount of the available FBHP is bled off because the higher mobility natural gas bypasses formation liquids 342 on their way up to the intake of insert pump 332. It would be better if the production tubing 312 and insert pump 332 setting depth was deeper in the horizontal well 330 but doing so would introduce costly damage to the sucker rods 334 and production tubing 312 due to abrasion wear as the sucker rods 334 reciprocate in an up and down cycle more than 10,000 times per day.

Also, if the FBHP and/or SRV and reservoir matrix is not feeding a sufficient volume of liquid to the intake 338 of the insert pump 332, the horizontal well 330 is in a pumped-off condition. A pumped off condition occurs when the fluid level in the casing/tubing annulus 346 is at or below the intake 338. Conventional rod pump lift systems are designed to have the intake always submerged completely in liquid and when they are not, significant damage can occur to the insert pump 332, the sucker rods 334, and other artificial lift equipment. Similarly, gas/liquid slugging 340 near the intake 338 can also damage the artificial lift equipment. Tortuous and/or downdip intervals of the horizontal section 306 typically increase backpressure on hydraulic fractures 308 and 310 and contribute to damaging erratic slug flow.

The FBHP at the midpoint 348 of horizontal section 306 for a typical rod pump lifted horizontal well 330 can be estimated by summing the flowing casing pressure (FCP), the hydrostatic head of the dry gas contained within the vertical section of the tubing/casing annulus from the insert pump 332 to the surface, the hydrostatic head of the oil/water/gas mixture flowing up the production casing 304 in the angle build section of the horizontal well 330 from the TVD of the directional kickoff point 374 to the TVD of the horizontal section 306, and the hydrostatic head of the oil/gas/water mixture contained in the horizontal section 306 due to formation dip (applicable to toe down well profiles) and the thickness of the SRV. For a typical 12000 feet TVD horizontal oil well with a producing GOR of less than 2500 SCF/BBL, a 6000 lateral feet toe down well profile, formation dip of 3°, 100 feet of SRV thickness, and 0.85 gravity fluid, the FBHP is estimated to be greater than 400 psi depending on the FCP resulting from local gas compression facilities.

Figure 3C:
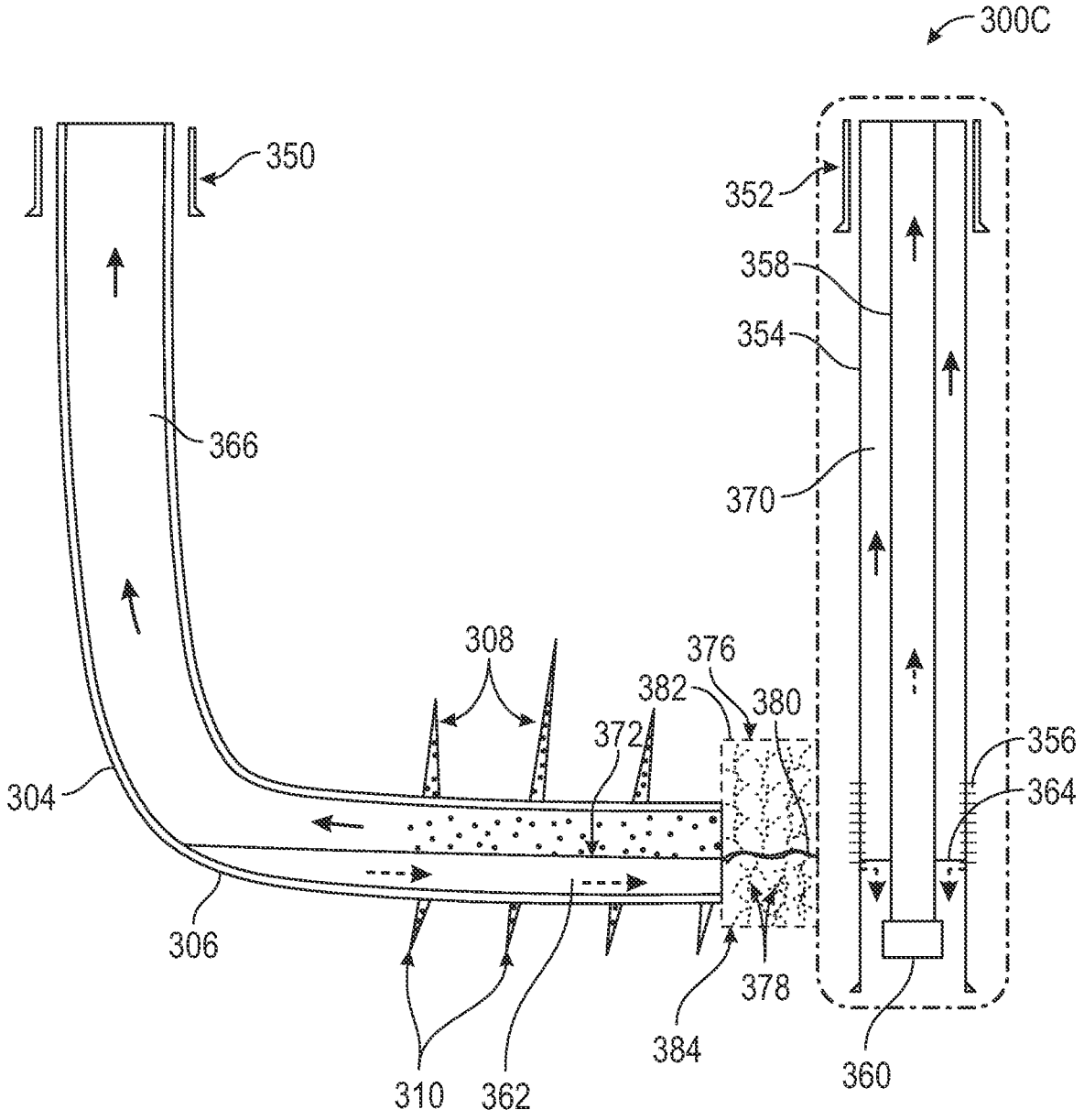
FIG. 3C is a cross-section view of a gravity assisted reservoir drainage system illustrating a preexisting horizontal well in a complex hydraulic fracture network and a new, substantially vertical, well.

In FIG. 3C, a cross-section view of a gravity assisted reservoir drainage system 300C is illustrated, which includes a preexisting horizontal well 350 in a complex hydraulic fracture network and a new, substantially vertical, well 352. The horizontal well 350 is configured without any production tubing or artificial lift system and feeds crude oil and formation water to the new well 352 via new hydraulic fractures 380 contained within the complex hydraulic fracture network of the combined SRV 376, which also includes non-overlapping hydraulic fractures 378.

The new well 352 is completed with cemented production casing 354 and perforations 356 through which a specially designed hydraulic fracture stimulation treatment is pumped to create new hydraulic fractures 380, which extend to the horizontal section 306 of the horizontal well 350. The new hydraulic fractures 380 are filled with proppant, permeable grout, or other permeable media to ensure they remain open and conductive throughout the productive life of the new well 352. Alternatively, the new hydraulic fractures 380 may be treated with acid to enhance their conductivity. Production tubing 358 and an instrumented downhole electric submersible pump (ESP) 360 are run into the production casing 354 of the new well 352 prior to initiating production. The intake for the pump 360 is preferably positioned below a bottom of the perforations 356 and a lower formation interval 384 of the combined SRV 376 for a lower take point in the reservoir.

During production operations, the pump 360 mechanically lifts crude oil and water up the production tubing 358 while dry gas is produced up the tubing/casing annulus 370 of new well 352. The pump 360 is instrumented with downhole electronic sensors to allow the liquid level 364 in the tubing/casing annulus 370 to be regulated such that the pump 360 is always submerged in liquid and never pumps off. In the horizontal section 306 of horizontal well 350, crude oil and formation water 362 flows into hydraulic fractures 308 and 310, which are hydraulically connected with the new hydraulic fractures 380 through the combined SRV 376 to feed into perforations 356 and down through the tubing/casing annulus 370 to the intake of the pump 360. If the horizontal well 350 is shut-in, the dry gas 366 will enter hydraulic fractures 308 and migrate up toward an upper formation interval 382 of the combined SRV 376 while displacing oil in pore space/ancillary fractures to enhance crude oil recovery via the pump 360. If the horizontal well 350 is open to production, dry gas 366 is produced up the production casing 304 of the horizontal well 350 because of the density difference between formation liquids and natural gas. In this case, the FBHP at the midpoint 372 of horizontal section 306 can be estimated by summing the FCP of horizontal well 350 and the hydrostatic head of the dry gas contained within the vertical section of the production casing 304 from the midpoint 372 of horizontal section 306 to the surface. For a typical 12000 feet TVD horizontal oil well with a producing GOR of less than 2500 SCF/BBL, a 6000 lateral feet toe down well profile, formation dip of 3°, 100 feet of SRV thickness, and 0.85 gravity fluid, the FBHP is estimated to be less than 80 psi depending on the FCP resulting from local gas compression facilities.

Figure 4:
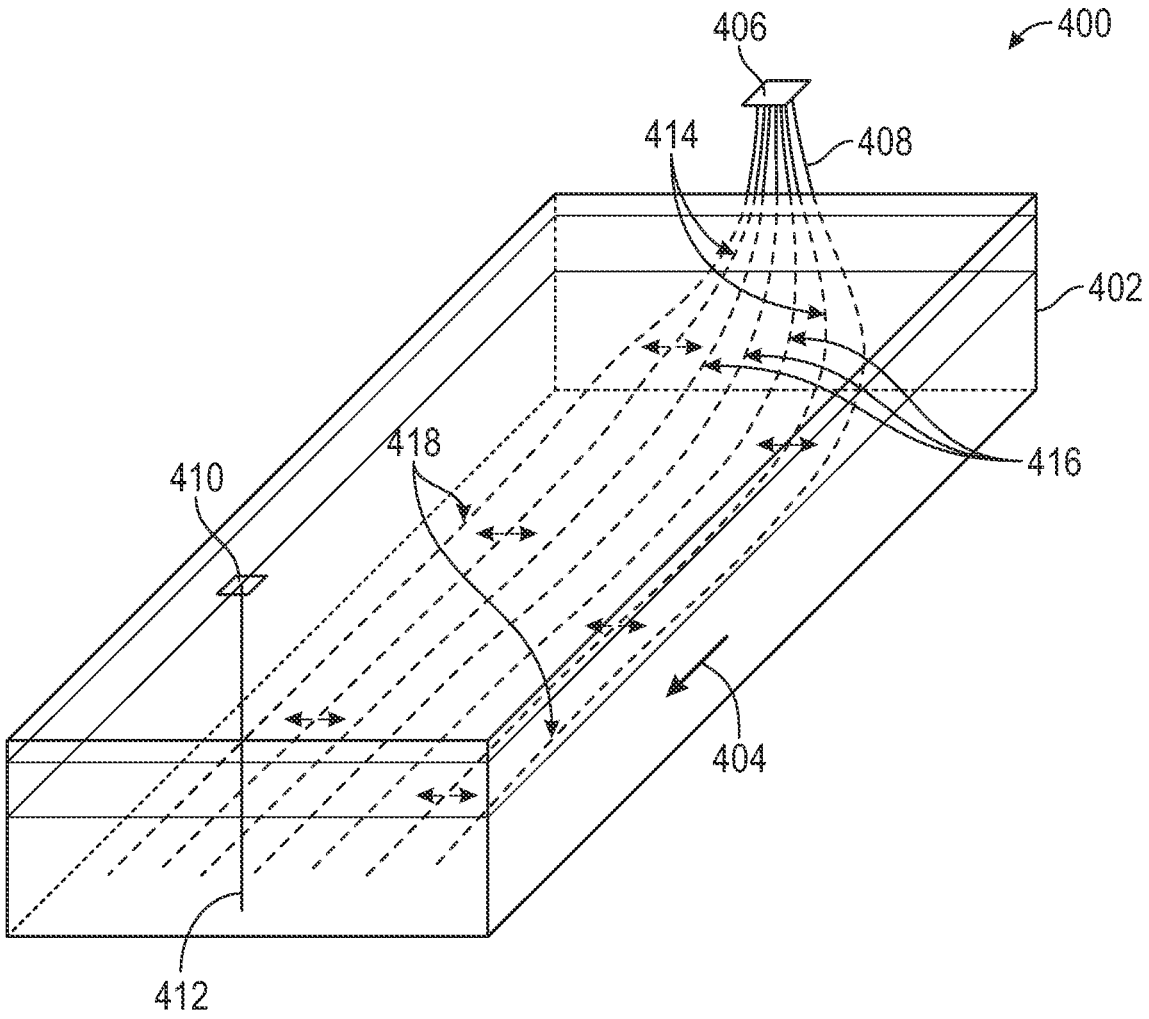
FIG. 4 is a perspective view of a gravity assisted reservoir drainage system illustrating a typical multi-well development pattern, which includes preexisting closely spaced horizontal wells in a complex hydraulic fracture network, and a new, substantially vertical, well.

Referring now to FIG. 4, a perspective view of a gravity assisted reservoir drainage system 400 is illustrated, which includes preexisting closely spaced horizontal wells, the complex hydraulic fracture network created during the completion of those horizontal wells, and a new, substantially vertical, well. A surface pad 406 provides the surface location for preexisting, closely spaced horizontal wells 408 that were used to produce liquids-rich hydrocarbons from the complex hydraulic fracture network of a combined SRV 402. The horizontal wells 408 were drilled in a downdip direction 404.

A new, substantially vertical, well 410 includes a downhole instrumented ESP or other mechanical pump 412 in a cased sump near or below a lower formation interval of the combined SRV 402 and is positioned about midway between two of the horizontal wells 408. The horizontal wells 408 are in hydraulic communication because of overlapping hydraulic fractures created during their original completion using batch multi-stage fracturing. The horizontal wells 408 are also in hydraulic communication with the new well 410 because of one or more overlapping hydraulic fractures created during completion of the new well 410.

During production operations under primary recovery (e.g., no gas injection as part of an IOR process), crude oil and formation water slowly migrate within the combined SRV 402 through both non-overlapping and overlapping hydraulic fractures and the horizontal section of each respective horizontal well 408 toward the cased sump in the new well 410 where the formation liquids are artificially lifted to the surface using the pump 412. During this process, associated natural gas migrates up toward an upper formation boundary of the combined SRV 402 while displacing oil in pore space/ancillary fractures to enhance crude oil recovery via the pump 412 or, alternatively, may be produced up the casing of the horizontal wells 408 for sales down a gas pipeline or for use in a gas injection IOR project.

During production operations under secondary recovery using continuous or huff n' puff cyclic gas injection, certain horizontal wells 408 may be used as gas injection wells while others may be shut-in at surface while their horizontal sections feed crude oil and formation water to the underlying cased sump in the new well 410 where the formation liquids are lifted to the surface using the pump 412. Two of the horizontal wells 408, for example, may be used as gas injector wells 414 while the three horizontal wells 408 between the gas injector wells 414 are left as shut-in at surface wells 416 and are only used to feed formation liquids to the pump 412. Ideally, the shut-in at surface wells 416 will land lower in the combined SRV 402 than the two gas injector wells 414. In this example, the two remaining horizontal wells 408 (outer wells 418) may be used for producing natural gas for recycling and to avoid off-lease migration of natural gas contained in the combined SRV 402. The lower reservoir take point within the new well 410 may increase the efficiency and effectiveness of multi-well cyclic gas huff-n' puff IOR operations by enabling the injected gas to stay in the combined SRV 402 longer before it is produced back. The injected gas migrates upward due to gravity segregation, which displaces oil in the pore space/ancillary fractures and allows oil to counterflow down to the pump 412.

The mechanisms leading to improved recovery efficiency of such gas injection IOR projects include increasing reservoir energy, reducing oil viscosity, and improving near wellbore fracture conductivity. More specifically, injecting gas above the current fracture gradient will clean and enhance fracture conductivity. Also, injecting above minimum miscibility pressure (MMP) in a multiple contact process swells the oil (i.e., increases its oil formation volume factor), reduces the oil viscosity, reduces interfacial tension between the oil molecules and the matrix, and acts as a solvent thereby improving local displacement efficiency of oil from the reservoir to the pump.

In summary, the gravity assisted reservoir drainage system disclosed herein significantly increases hydrocarbon recovery from the interconnected SRVs underlying a densely developed lease by (a) maximizing gravity drainage in the reservoir where liquids feed down to the vertical well's sump pump while associated free gas accumulates in structurally high areas of the reservoir to maximize gas expansion drive effects or is produced from the network of hydraulically-connected horizontal wells to a gas pipeline or to feed a gas injection IOR project, (b) improving Darcy flow effects via increased pressure drawdown from the reservoir matrix to the pump, which results from reducing the FBHP at the pump inlet to less than about 80 psi, and (c) significantly lowering the reservoir pressure at abandonment.

Concentrating liquid production in a single new, substantially vertical, well will also reduce operating expenses on a unit of production basis because each interconnected horizontal well will no longer need to be artificially lifted and the pump efficiency in the new well will be relatively high since gas-free incompressible liquids will be constantly feeding the sump pump. Also, the mean time between pump, rod, and tubing failures will be much longer in the new well than a typical mechanical pump running in a horizontal well due to the mitigation of damaging pump off, fluid pounding, and/or gas lock conditions.

Additional benefits may result from improving liquids recovery during the process of drilling and completing new infill child horizontal wells and/or re-stimulation (e.g., re-fracture treatment) of existing parent horizontal wells. Also, the lower reservoir take point within the new well will increase the efficiency and effectiveness of multi-well cyclic gas huff-n' puff IOR operations by enabling the injected gas to stay in the multi-SRV reservoir longer before it is produced back.

While the present disclosure has been described in connection with presently preferred embodiments, it will be understood by those skilled in the art that it is not intended to limit the disclosure of those embodiments. It is therefore, contemplated that various alternative embodiments and modifications may be made to the disclosed embodiments without departing from the spirit and scope of the disclosure defined by the appended claims and equivalents thereof.

The invention claimed is:

1. A gravity assisted reservoir drainage system, which comprises:

a plurality of preexisting horizontal wells, wherein each preexisting horizontal well is located within a respective stimulated reservoir volume created during its completion and which includes at least one non-overlapping hydraulic fracture;

at least one overlapping hydraulic fracture fluidly connecting at least one of the plurality of preexisting horizontal wells to an adjacent one of the plurality of preexisting horizontal wells; and a new well, wherein the new well is completed within a stimulated reservoir volume containing the at least one overlapping hydraulic fracture after completion of the plurality of preexisting horizontal wells and includes a hydraulic fracture fluidly connecting the new well and at least one of the plurality of preexisting horizontal wells connected by the at least one overlapping hydraulic fracture.

2. The system of claim 1, wherein each preexisting horizontal well is batch completed with staged fracturing.

3. The system of claim 1, wherein each preexisting horizontal well is centrally positioned within the respective stimulated reservoir volume.

4. The system of claim 1, wherein the new well is laterally positioned between two respective preexisting horizontal wells connected by the at least one overlapping hydraulic fracture.

5. The system of claim 4, wherein the new well is longitudinally positioned proximate to a downdip bottomhole location of at least one of the respective preexisting horizontal wells connected by the at least one overlapping hydraulic fracture.

6. The system of claim 4, wherein the new well is laterally positioned between 5 feet and 220 feet from a cased section of at least one respective preexisting horizontal well connected by the at least one overlapping hydraulic fracture.

7. The system of claim 1, wherein the new well is completed with perforations and a hydraulic fracture stimulation treatment.

8. The system of claim 1, wherein each stimulated reservoir volume includes a common upper formation interval and a common lower formation interval.

9. The system of claim 8, wherein the new well includes cemented production casing, perforations, production tubing, and a pump positioned below the perforations and the common lower formation interval.

* * * * *